US006017405A

United States Patent [19]

Pankoke

[11] Patent Number: 6,017,405

[45] Date of Patent: Jan. 25, 2000

[54] METHOD OF MAKING PLATES OR PROFILED WORKPIECES FROM ANNUAL PLANTS

[75] Inventor: Werner Pankoke, Bielefeld, Germany

[73] Assignee: Firma Theodor Hymmen, Bielefeld, Germany

[21] Appl. No.: 09/069,323

[22] Filed: Apr. 29, 1998

[30] Foreign Application Priority Data

May 2, 1997 [DE] Germany ..... 197 18 352

[51] Int. Cl.[7] ..... B27N 3/08

[52] U.S. Cl. ..... 156/62.2; 156/256; 156/275.5; 264/116; 264/118

[58] Field of Search ..... 156/62.2, 62.4, 156/272.2, 273.2, 275.5, 256; 264/115, 116, 118; 428/68, 74, 76; 100/3

[56] References Cited

U.S. PATENT DOCUMENTS 5,284,546 2/1994 Tilby .

*Primary Examiner*—Sam Chaun Yao
*Attorney, Agent, or Firm*—Henry M. Feiereisen

[57] ABSTRACT

A method of making plates or profiled workpieces from annual plants such as flax, straw, hemp, rice, reed, sugar cane, cotton stem, includes the steps of pressing plant parts of annual plants into bales after harvesting and completely wrapping the bales with a liquid-tight, vapor-permeable sheet. The wraped bales can then be stored until further processing which can be effected without subjecting the bales to an additional drying operation. Unsuitable plant parts such as dust, foreign matters and the like may be separated after harvesting from the useful plant parts before the latter are pressed to bales and wraped by a sheet.

9 Claims, No Drawings

METHOD OF MAKING PLATES OR PROFILED WORKPIECES FROM ANNUAL PLANTS

BACKGROUND OF THE INVENTION

The present invention generally relates to a method of making plates or profiled workpieces from annual plants, such as flax, straw, hemp, rice, reed, sugar cane, cotton stem, and in particular is directed to a method in which the plant parts are comminuted, glued and subsequently pressed.

A conventional method for fabricating plates or boards of straw is known in which straw obtained during harvesting of grain is pressed into bales, and the bales are subsequently stored. Evidently, a harvesting of large grain fields results in a respectively large number of straw bales so that storage of such bales for protection against weather influence poses a significant problem. As roofed storage spaces are normally not available for such quantities of straw bales, the straw bales are stored outdoors. Even when covering the bales by canvases or wrappings, the moisture content of the bales during storage will in some areas substantially increase thereby diminishing the quality of the raw material for fabrication of the plates. Also, the quality on the outside of the bale stack may also be adversely affected when stored outdoors through incident ultraviolet radiation.

In the event, the raw material obtained from annual plants for fabrication of plates or profiled workpieces has a high moisture content and/or variances in moisture content, the process requires the provision of a separate dryer. Apart from the high energy consumption for conducting a drying operation, the additional arrangement of a dryer necessitates a cleaning of exhaust air to prevent release of harmful agents into the environment. Normally, this is done by incorporating a vent discharge and dedusting unit which exhibits an air throughput of 20,000 $m^3/h$ already for a small dryer with an output of 14 dlh.

SUMMARY OF THE INVENTION

It is thus an object of the present invention to provide an improved method of making plates or profiled workpieces from annual plants, obviating the afore-stated drawbacks.

In particular, it is an object of the present invention to provide an improved method of making plates or profiled workpieces from annual plants, which permits an inexpensive storage of raw material and maintains the quality of harvested plant parts while yet is simple to carry out, without requiring complex devices and thus is cost-efficient.

These objects, and others which will become apparent hereinafter, are attained in accordance with the present invention by pressing the harvested plant parts into bales, and completely wrapping the bales with a liquid-tight, vapor permeable sheet for storage until subsequent processing, whereby processing of the stored plant parts can be carried out without necessitating any additional drying operation.

DETAILED DESCRIPTION OF PREFERRED EMBODIMENTS

In order to provide the raw material for making plates or profiled workpieces, annual plants are initially harvested, and subsequently, the plant parts are pressed into bales. A specific construction and manner in which the harvested plants are pressed into bales is fully described in German Pat. No. DE 28 46 650 C2 which discloses a round baler, or German Pat. No. DE 40 20 497 C2 which discloses a baler for fabricating rectangular large scale bales. The entire specification and drawings of German Pat. Nos. DE 28 46 650 C2 and DE 40 20 497 C2 are expressly incorporated herein by reference.

After producing the bales of plant parts through utilization of a suitable baler, the round, rectangular, cylindrical or other suitably shaped bales are wrapped with a protective plastic sheet. By wrapping the individual bales with a plastic sheet which is sealed by one or more welding seams, the single bales can be stored outdoors on the field over a period of several months or years until being used as raw material for fabrication of plates or profiled workpieces. The storage of such wrapped bales maintains the quality of the harvested plant chips and can even be improved because the vapor permeable sheet permits an escape of remaining moisture from the bales of plant chips toward the outside, thereby further decreasing the moisture content. As harvesting is carried out at dry weather conditions and the pressing step of the bales as well as the wrapping step with the sheet are done after harvesting, the bales have only a residual moisture content, whereby an equilibrium moisture content establishes during the storage period.

Wrapping of the bales can be effected by a conventional bale wrappers that are known in a variety of designs. A detailed description thereof is omitted for the sake of simplicity.

Thus, the present invention teaches a method that leads to a very dry raw material that can be processed to plates or profiled workpieces, while eliminating the need for a complex dryer so that the raw material, after being comminuted, can immediately be applied with glue, and the glued parts shaped and pressed into mats. The elimination of a separate drying zone during processing of the bales of pressed plant parts into free-flowing and glue-coated small plant matters significantly reduces the complexity of the overall apparatus for carrying out the process, resulting in reduced energy consumption and elimination of any adverse impact on the environment through a drying operation.

According to another embodiment of the present invention, the harvested plant matters are screened for separating components, such as dust, foreign matters or the like which are unsuitable for subsequent fabrication of plates or workpieces, and left on the field while the useful plant parts are pressed into bales, wrapped by a sheet and subsequently stored. For screening the harvested plant matters, a conventional thresher or a harvester-thresher may be used.

According to still another embodiment of the present invention, the harvested plant matters are pre-pressed to a strand and the pre-pressed strand is subsequently milled, with the comminuted plant chips obtained through the milling step being pressed into bales and wrapped in a sheet for storage until further processing.

Preferably, the wrapping step is carried out together with the pressing step of the plant matters into bales.

Advantageously, the sheet for wrapping the bales of pressed plant parts is suitably comminuted after use as wrapping material and admixed as binder to the plant parts during subsequent processing. Preferably, the sheet is made of a plastic material such as polyethylene. Suitably, the polyethylene sheet is exposed to electron beam radiation or gamma radiation to induce cross linking, resulting in a reduction in the melt flow index.

In the event, the pressed bales are wrapped by a sheet of a material that cannot be admixed to the comminuted plant matter as binder in comminuted form, the wrapping sheet can be reused and recycled. Such a sheet is e.g. a polyethylene film which is not irradiated.

In order to prevent a deterioration of quality on the outside of the bale stack when exposed to UV radiation, the wrapping sheet is suitably made of a material impervious to UV radiation, e.g. polyethylene.

While the invention has been illustrated and described as embodied in a method of making plates or profiled workpieces from annual plants, it is not intended to be limited to the details shown since various modifications and structural changes may be made without departing in any way from the spirit of the present invention.

What is claimed as new and desired to be protected by Letters Patent is set forth in the appended claims:

1. A method of preparing a raw material for making plates or profiled workpieces from annual plants, comprising the steps of:

pressing the plant parts of annual plants into bales after harvesting;

completely wrapping the bales with a liquid-proof, vapor-permeable sheet;

storing the wrapped bales to decrease their moisture content until further processing; and thereafter comminuting, glueing and pressing the plant parts into plates and profiled work pieces; and comminuting the sheet and adding comminuted sheet material to the plant parts binder prior to subjecting the plant parts to pressing, without an additional drying operation.

2. The method of claim 1 wherein the wrapping step and the pressing step are executed at a same time.

3. The method of claim 1 wherein the sheet is made of polyethylene.

4. The method of claim 3 wherein the sheet is exposed to radiation selected from the group consisting of electron beam radiation and gamma radiation.

5. The method of claim 1 wherein the sheet is impervious to UV radiation.

6. A method of making plates or profiled workpieces from annual plants, comprising the steps of:

separating unsuitable plant parts of annual plants such as dust, foreign matter and the like from useful plant parts after harvesting;

leaving the unsuitable plant parts on the harvested field;

pressing the useful plant parts into bales;

completely wrapping the bales with a liquid-proof, vapor-permeable sheet; and storing the wrapped bales to reduce their moisture content and thereafter comminuting, glueing and pressing the plant parts into plates and profiled work pieces and comminuting the sheet and adding comminuted sheet material to the plant parts as binder prior to subjecting the plant parts to pressing, without an additional drying operation.

7. The method of claim 6 wherein the sheet is made of polyethylene.

8. The method of claim 7 wherein the sheet is exposed to radiation selected from the group consisting of electron beam radiation and gamma radiation.

9. The method of claim 6 wherein the sheet is impervious to UV radiation.

* * * * *